US009977403B2

(12) United States Patent
Leoni et al.

(10) Patent No.: US 9,977,403 B2
(45) Date of Patent: May 22, 2018

(54) WATCH CASE PROVIDED WITH AN EXTERNAL ELEMENT

(71) Applicant: ETA SA Manufacture Horlogere Suisse, Grenchen (CH)

(72) Inventors: Stephane Leoni, Courtelary (CH); Sebastian Studer, Gossliwil (CH)

(73) Assignee: ETA SA Manufacturing Horlogere Suisse, Grenchen (CH)

( * ) Notice: Subject to any disclaimer, the term of this patent is extended or adjusted under 35 U.S.C. 154(b) by 0 days. days.

(21) Appl. No.: 15/326,742

(22) PCT Filed: Jul. 13, 2015

(86) PCT No.: PCT/EP2015/065973
§ 371 (c)(1),
(2) Date: Jan. 17, 2017

(87) PCT Pub. No.: WO2016/023695
PCT Pub. Date: Feb. 18, 2016

(65) Prior Publication Data

US 2017/0205770 A1 Jul. 20, 2017

(30) Foreign Application Priority Data

Aug. 12, 2014 (EP) ..... 14180687

(51) Int. Cl.
*G04B 37/14* (2006.01)
*G04B 19/22* (2006.01)
*G04B 45/00* (2006.01)

(52) U.S. Cl.
CPC ..... *G04B 37/1486* (2013.01); *G04B 19/223* (2013.01); *G04B 45/0076* (2013.01)

(58) Field of Classification Search
CPC ..... G04B 37/1486; G04B 19/223; G04B 45/0076; G04B 37/005; G04B 47/046;
(Continued)

(56) References Cited

U.S. PATENT DOCUMENTS 4,207,735 A * 6/1980 Ishigaki ..... G04B 19/14 368/236
5,158,219 A * 10/1992 Baumgartner ..... G04B 37/1486 224/164
(Continued)

FOREIGN PATENT DOCUMENTS

EP 1 950 632 A1 7/2008
EP 1 975 748 A1 10/2008
EP 2 749 966 A1 7/2014

OTHER PUBLICATIONS

International Search Report dated Dec. 2, 2015 in PCT/EP2015/065973 filed Jul. 13, 2015.
(Continued)

*Primary Examiner* — Edwin A. Leon
(74) *Attorney, Agent, or Firm* — Oblon, McClelland, Maier & Neustadt, L.L.P.

(57) ABSTRACT

A watch case includes a case middle, a bezel, and an external element at least partially disposed between the case middle and the bezel. The bezel includes at least one hollow revealing the external element. The external element is attached directly to the case middle, independently of an attachment of the bezel to the case middle.

9 Claims, 2 Drawing Sheets

(58) Field of Classification Search
CPC .. G04B 37/0058; G04B 37/22; G04B 37/228; A44C 5/14
USPC ..... 368/282, 295
See application file for complete search history.

(56) References Cited

U.S. PATENT DOCUMENTS

| | | | | |
|---|---|---|---|---|
| 6,456,569 | B1 * | 9/2002 | Stauffer | G04B 19/06 368/236 |
| 8,931,949 | B2 * | 1/2015 | Erard | G04B 19/28 368/295 |
| 2008/0181061 | A1 | 7/2008 | Girardin et al. | |

OTHER PUBLICATIONS

International Preliminary Examination Report dated Jul. 28, 2016 in PCT/EP2015/065973 filed Jul. 13, 2015.

* cited by examiner

WATCH CASE PROVIDED WITH AN EXTERNAL ELEMENT

FIELD OF THE INVENTION

The invention relates to a watch case comprising an external element which gives the watch a particular aesthetic appearance.

BACKGROUND OF THE INVENTION

There is known from CH Patent 640690 a watch case comprising a case middle equipped with a decorative part in the form of a ring, the ring being engaged in a groove provided in the visible face of the case middle, and being partially covered by bridges integral with a bezel mounted on the case middle.

There is also known from EP Patent 1098233 a watch case comprising a rotating metal bezel having over all or part of its surface projecting inserts made of a synthetic material.

The watch cases described above have several drawbacks. It will be mentioned firstly that the machining and/or manufacturing operations are complex, which results in an increase in manufacturing costs. Further, the assembly process requires several steps, which results in an increase in manufacturing time. Finally, it will be observed that the decorative part requires specific machining according to the desired aesthetic effect, which means several references must be stored.

SUMMARY OF THE INVENTION

It is an object of the invention to overcome the various drawbacks of these known techniques.

More specifically, it is an object of the invention to provide a single external element allowing several aesthetic designs to be obtained in combination with a bezel having one or more hollows of different sizes and different shapes.

It is also an object of the invention, at least in a particular embodiment, to provide an external element that is simple to implement, easy to assemble and inexpensive.

These objects, in addition to others which will appear more clearly below, are achieved according to the invention by means of a watch case comprising a case middle provided with horns and having two areas for the attachment of a bracelet strand to said case middle, a bezel and an external element disposed at least partially between said case middle and said bezel, said bezel comprising at least one hollow configured to reveal said external element.

According to the invention, said external element comprises two covering elements respectively covering each attachment area and is directly attached to said case middle, independently of the attachment of said bezel to said case middle, and the case middle comprises, in each attachment area, two vertical ribs between the horns, configured to cooperate with two guide grooves formed on the inner face of the covering elements, so as to hold the external element correctly in place on the case middle.

In accordance with other advantageous variants of the invention:

- said external element comprises a ring at least partially covering said case middle, said ring being housed between said case middle and said bezel so as to form a decorative surface at the bottom of said at least one hollow;
- said ring and said two covering elements of said external element form a one-piece component;

- said external element is snap-fitted on to said case middle by means of said covering elements in the attachment areas;
- said ring of said external element has a substantially semi-toroidal cross-section;
- said ring lies substantially flush across all or part of the peripheral surface of said case middle;
- said external element is made of plastic material such as polycarbonate, PMMA or MABS;
- said bezel comprises at least two hollows symmetrically arranged around said bezel;
- said external element is formed from a transparent or opaque material having a matt or polished surface.

Thus, the object of the present invention, by means of the different functional and structural aspects described above, is to obtain a watch case that can easily have different aesthetic appearances.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
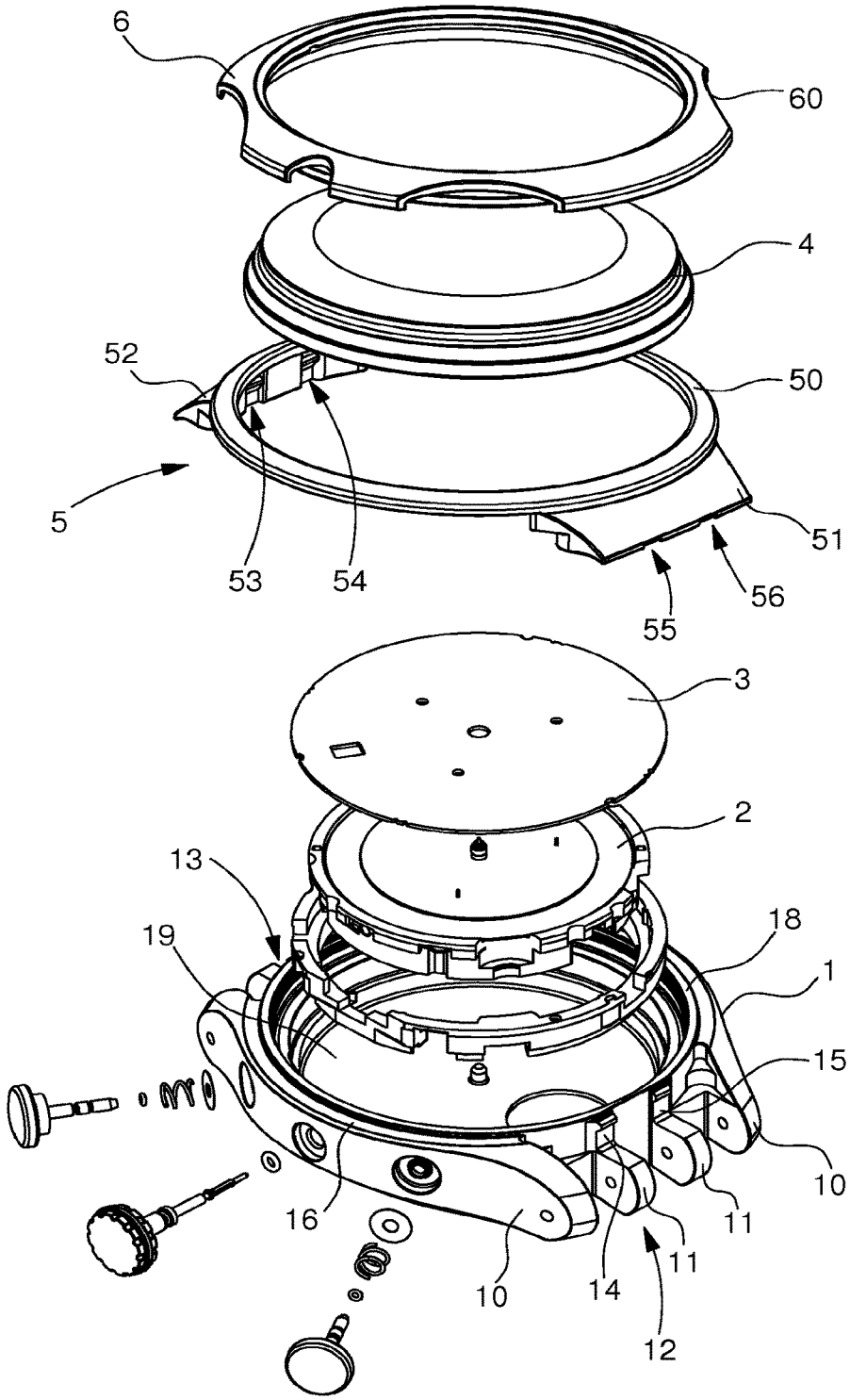
FIG. 1 is an exploded view of a watch case according to the invention.

A watch case 100 according to an example embodiment will now be described below with reference jointly to FIGS. 1, 2 and 3.

As stated above, the general principle of the invention is based on the use of a watch case 100 comprising a case middle 1, a bezel 6 and an external element 5 at least partially disposed between case middle 1 and bezel 6, bezel 6 comprising at least one hollow 60 revealing said external element 5.

According to the invention, external element 5 and bezel 6 are attached to case middle 1 directly and independently of each other, the shape of bezel 6 being complementary to the shape of external element 5. Thus, external element 5 is securely attached to case middle 1 clasped between case middle 1 and bezel 6.

Figure 2:
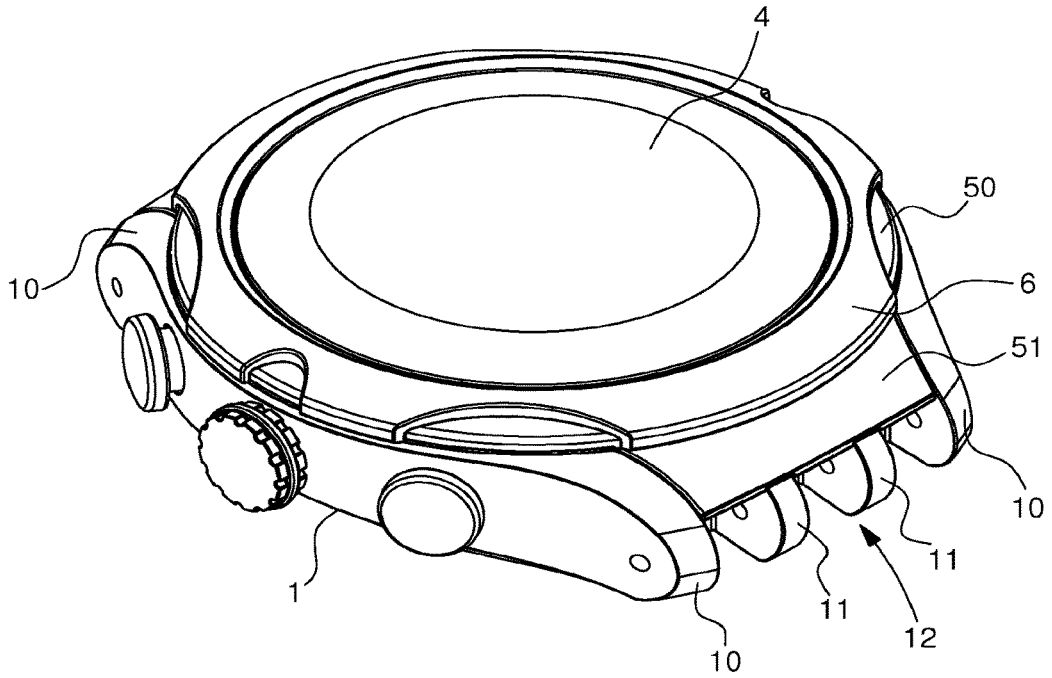
FIG. 2 is a perspective view of a watch case according to the invention.
Figure 3:
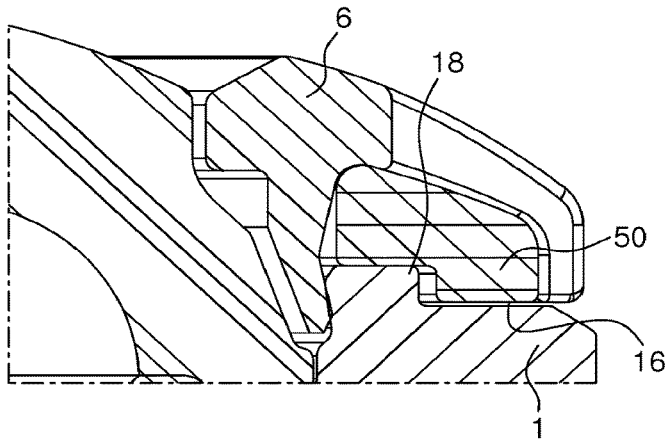
FIG. 3 is a cross-sectional view along the line III-III of FIG. 2 of the watch case according to the invention.

According to a non-limiting embodiment illustrated in FIG. 2, bezel 6 comprises at least two hollows 60 symmetrically arranged around bezel 6. The hollow or hollows 60 may be of semi-circular, semi-elliptic or polygonal shape, since the shape of hollows 60 depends on the desired aesthetic appearance.

It will also be noted that external element 5 may present different colours according to the model of the watch.

According to a variant of the invention, bezel 6 and case middle 1 are made of a metal material, such as steel or aluminium. Of course, any other material known to those skilled in the art could have been used.

As can be observed in the Figures, external element 5 comprises a ring 50 configured to cover all or part of the external surface of case middle 1, such that ring 50 lies substantially flush across all or part of the peripheral surface of case middle 1, with ring 50 resting on a peripheral edge 18 of case middle 1 and on the collar 16 of case middle 1. Advantageously, external element 5 is guided onto collar 16 of case middle 1 by means of peripheral edge 18.

Ring 50 at least partially covers case middle 1 on peripheral edge 18, ring 50 being housed between case middle 1 and bezel 6 so as to form a decorative surface at the bottom of hollow 60.

Watch case 100 also includes two areas 12, 13 for the attachment of a bracelet strand to case middle 1. Case middle 1 is downwardly delimited by a back cover 19 integral with case middle 1, and comprises at 6 o'clock a pair of outer horns 10 and a pair of inner horns 11, as in the example represented, for the attachment of a bracelet strand (not illustrated). Of course, at 12 o'clock, case middle 1 comprises the same number of horns (not visible in the Figures), for the attachment of a second bracelet strand.

As can be observed in FIGS. 1 and 2, ring 50 comprises two covering elements 51, 52 respectively covering each of the two attachment areas 12, 13 located at 6 o'clock and 12 o'clock on case middle 1. These covering elements 51, 52 are arranged to cover attachment areas 12, 13, with the shape of the bracelet strands attached to case middle 1 being devised not to lever out external element 1. These covering elements 51, 52 also have the function of improving the aesthetic appearance of the watch by concealing attachment areas 12, 13 between case middle 1 and the bracelet strands.

According to a preferred embodiment of the invention, ring 50 and the two covering elements 51, 52 of external element 5 form a one-piece component. According to this embodiment, external element 5 is made of a plastic material, such as polycarbonate, PMMA, or MABS, by means of injection moulding, for example. It will be understood here that other materials may be envisaged by those skilled in the art within the scope of the present invention.

Depending on the end result desired for the watch, external element 5 may have a matt or polished appearance, or be transparent or opaque. A combination of these different appearances is possible.

As can be observed in FIG. 1, case middle 1 comprises in each attachment area 12, 13, two vertical ribs 14, 15 intended to hold external element 5 correctly in place at covering elements 51, 52 between horns 10, covering elements 51, 52 having, on their inner face, two guide grooves 53, 54 configured to cooperate with vertical ribs 14, 15. Of course, a single rib and a single groove may be sufficient to hold external element 5.

External element 5 comprises, in each covering element 51, 52, two snap fit slots 55, 56 formed underneath covering elements 51, 52 and intended to cooperate with inner horns 11. Thus, external element 5 is snap-fitted on to said case middle by means of said covering elements 51, 52 in the attachment areas 12, 13.

As represented in the Figures, ring 50 has a flat outer surface, i.e. ring 50 has no projecting portion housed inside said at least one hollow 60 of bezel 6. External element 5 thus has a simple geometric shape, which allows for fast, easy and inexpensive manufacture.

According to a variant of the invention, not illustrated in the Figures, external element 5 has portions that protrude at hollows 60 of bezel 6.

The pairing of external element 5/bezel 6 makes it possible to obtain a plurality of aesthetic effects according to the colour and/or the appearance of external element 5, and according to the number of hollows 60 provided in bezel 6, and their size and shape.

The assembly of the watch is achieved as follows.

The operator snap fits external element 5 onto case middle 1 in attachment areas 12, 13. Next, the operator places the movement 2/dial 3 assembly on back cover 19 of case middle 1, and then inserts the stem with its crown into case middle 1 and movement 2. Finally, glass 4 is pressed onto case middle 1, then bezel 6 is also attached so as to obtain the desired positioning of hollows 60.

As a result of these different aspects of the invention, there is provided an easy-to-assemble watch case allowing for a large variety of models depending on the colour of external element 5 and the shape of bezel 6.

Of course, the present invention is not limited to the illustrated example and is capable of various variants and modifications that will appear to those skilled in the art.

NOMENCLATURE

100. Watch case,
1. Case middle,
10. Outer horns,
11. Inner horns,
12,13. Attachment areas,
14,15. Guide ribs,
16. Collar,
18. Edge,
19. Back cover,
2. Movement,
3. Dial,
4. Glass,
5. External element,
50. Ring,
51,52. Covering elements,
53,54. Guide groove,
55,56. Snap fit slot,
6. Bezel,
60. Hollows.

The invention claimed is:

1. A watch case comprising:

a case middle provided with horns and having two areas for attachment of a bracelet strand to said case middle, a bezel, and an external element at least partially clasped between said case middle and said bezel, said bezel comprising at least one hollow configured to reveal said external element, wherein said external element comprises two covering elements respectively covering each attachment area and is directly attached to said case middle, independently of an attachment of said bezel to said case middle, and the case middle comprises in each attachment area, two vertical ribs between the horns, configured to cooperate with two guide grooves formed on an inner face of the covering elements, so as to hold the external element correctly in place on the case middle.

2. The watch case according to claim 1, wherein said external element comprises a ring at least partially covering said case middle, said ring being housed between said case middle and said bezel so as to form a decorative surface at a bottom of said at least one hollow.

3. The watch case according to claim 2, wherein said ring and said two covering elements of said external element form a one-piece component.

4. The watch case according to claim 1, wherein said external element is snap fitted onto said case middle by means of said covering elements in the attachment areas.

5. The watch case according to claim 2, wherein said ring of said external element has a substantially semi-toroidal cross-section.

6. The watch case according to claim 2, wherein said ring lies substantially flush across all or part of a peripheral surface of said case middle.

7. The watch case according to claim 1, wherein said external element is made of a plastic material such as polycarbonate, PMMA or MABS.

8. The watch case according to claim 1, wherein said bezel comprises at least two hollows symmetrically arranged around said bezel.

9. The watch case according to claim 1, wherein said external element is made of a transparent or opaque material having a matt or polished surface.

* * * * *